US010640935B2

(12) United States Patent
Li et al.

(10) Patent No.: US 10,640,935 B2
(45) Date of Patent: May 5, 2020

(54) SEGMENTAL JOINT OF CAST-IN-PLACE UHPC BEAM BRIDGE AND CONSTRUCTION METHOD THEREOF

(71) Applicant: Changsha University of Science & Technology, Changsha, Hunan (CN)

(72) Inventors: Chuanxi Li, Hunan (CN); Zheng Feng, Hunan (CN)

(73) Assignee: Changsha University of Science & Technology, Changsha (CN)

( * ) Notice: Subject to any disclaimer, the term of this patent is extended or adjusted under 35 U.S.C. 154(b) by 0 days.

(21) Appl. No.: 16/248,769

(22) Filed: Jan. 16, 2019

(65) Prior Publication Data

US 2019/0309488 A1 Oct. 10, 2019

(30) Foreign Application Priority Data

Apr. 9, 2018 (CN) ..... 2018 1 0310491

(51) Int. Cl.

| | |
|---|---|
| ***E01D 19/00*** | (2006.01) |
| ***E01D 19/06*** | (2006.01) |
| ***B28B 1/14*** | (2006.01) |
| ***B28B 11/24*** | (2006.01) |
| ***E01D 21/00*** | (2006.01) |
| *E01D 101/24* | (2006.01) |
| *E01D 101/26* | (2006.01) |

(52) U.S. Cl.

CPC ..... *E01D 19/067* (2013.01); *B28B 1/14* (2013.01); *B28B 11/245* (2013.01); *E01D 21/00* (2013.01); *E01D 2101/24* (2013.01); *E01D 2101/268* (2013.01)

(58) Field of Classification Search

CPC ... E01D 19/067; E01D 21/00; E01D 2101/24; E01D 2101/268; B28B 1/14; B28B 11/245

USPC ..... 14/73, 74.5, 77.1; 52/223.1–223.14

See application file for complete search history.

(56) References Cited

U.S. PATENT DOCUMENTS 2,910,152 A * 10/1959 Edgar ..... E04B 5/48 52/474
RE25,364 E * 4/1963 Jacobson ..... E04D 3/30 52/579
5,603,134 A * 2/1997 Whipkey ..... E01D 15/133 14/2.4

(Continued)

*Primary Examiner* — Raymond W Addie

(74) *Attorney, Agent, or Firm* — Wayne & Ken, LLC; Tony Hom

(57) ABSTRACT

A segmental joint of cast-in-place UHPC bridge beam. The joint comprises a female joints at an end of a first segment and male joints at an end of a second segment, wherein each female joints and the male joints are correspondingly connected to form a tongue-and-groove connection, and each of the male joints is of a structure with big outer part and small inner part. The beam segment joint of the present disclosure improves the structural strength of the bridge and facilitates on-site construction, which not only applies to the joint connection between the segmental cast-in-place UHPC beam segments and the construction of the segmental cast-in-place UHPC beam segment, but also to joint connection of UHPC bridge deck of UHPC-steel composite beam and of full UHPC bridge deck of UHPC composite box girder with corrugated steel webs and to UHPC bridge deck construction.

8 Claims, 11 Drawing Sheets

(56) References Cited

U.S. PATENT DOCUMENTS

| | | | | |
|---|---|---|---|---|
| 6,089,359 | A * | 7/2000 | Tanaka | B60T 7/042 188/156 |
| 7,069,614 | B1 * | 7/2006 | Sivachenko | E01D 2/00 14/73 |
| 7,627,921 | B2 * | 12/2009 | Azizinamini | E01D 2/00 14/74.5 |
| 8,141,314 | B2 * | 3/2012 | Rosan | E04F 15/105 52/589.1 |
| 9,915,045 | B1 * | 3/2018 | Azizinamini | E01D 2/00 |
| 10,494,779 | B2 * | 12/2019 | Dagher | E04C 3/291 |

* cited by examiner

SEGMENTAL JOINT OF CAST-IN-PLACE UHPC BEAM BRIDGE AND CONSTRUCTION METHOD THEREOF

CROSS-REFERENCE TO RELATED APPLICATIONS

This application claims the benefit of priority from Chinese Patent Application No. CN201810310491.8, filed on Apr. 9, 2018. The content of the aforementioned application, including any intervening amendments thereto, is incorporated herein by reference in its entirety.

TECHNICAL FIELD

The present disclosure relates to a segmental joint of cast-in-place UHPC bridge beam and a construction method thereof, which belongs to the field of UHPC bridge structure.

BACKGROUND OF THE PRESENT INVENTION

Segmental cast-in-place (including hanging basket pouring, moving formwork pouring, bracket segment pouring) is one of the common construction methods for long-span and extra-long-span bridges.

Due to compactness (and therefore good durability) and excellent mechanical properties (compressive strength ≥150 MPa, flexural strength ≥20 MPa, tensile strength ≥8 MPa, elastic modulus ≥40 GPa), ultra-high performance concrete (abbreviated as UHPC, the same below) has broad application prospects in bridge engineering. When the length of a bridge connection unit is long, due to the limitation of mixing, curing and transportation of UHPC, whether UHPC is used in UHPC-steellightweight composite bridge deck, or in UHPC-steel composite beam or UHPC beam, the connection problems are inevitable.

In calculation of a bridge structure based on the normal bearing capacity limit and normal service limit state, the tensile strength of conventional concrete (including non-ultra-high-strength concrete such as concrete and high-strength concrete) is usually not considered due to its low tensile strength. Rather, the tensile performance of the bridge structures is provided by reinforcing bars or prestressed strands. The bending joint is in the form of a conventional flat joint (i.e., a planar joint) (the segment is subjected to a chiseling process). The high tensile strength of UHPC has an important impact on the economic rationality of UHPC bridges. The steel fiber at the longitudinal seam (joint) is discontinuous, and the tensile strength at the traditional flexural joint is significantly lower than that at the non-joint continuous pouring parts (about 10% of the non-joint continuous pouring parts), making it a weak section (control section) of the UHPC bridge, which requires more prestressed strands to be added to compensate for the tensile strength at the joints. In addition, the discontinuity of the steel fibers at the joints will also have a large adverse effect on the shear bearing capacity of the joints. To this end, many scholars studied the UHPC layers joint in UHPC-steellightweight composite bridge deck and in the segmental prefabricated UHPC beams, and proposed some suggestions for the joint forms suitable for these composite bridge. However, a joint suitable for cast-in-place UHPC continuous bridges has not been reported.

The joints for the UHPC-steellightweight composite bridge deck developed in the previous studies mainly solve the problem of improving the bending capacity (low shear stress) (the tensile capacity of a reasonable shape of the trapezoidal joint can reach 60%~80% that of a continuous cast-in-place part), and the joints between the segmental prefabricated UHPC beam segments developed mainly solve the problem of improving the shear capacity (the bending resistance is provided by the prestressed strands). However, one of the key problems to be solved by the present disclosure is to improve the shearing and bending between the segmental cast-in-place beam segments (after the beam segment poured firstly reaches a certain strength, then an adjacent beam segment is poured subsequently).

Studies have shown that after 24 to 48 hours of standard curing of the beam segment, steam curing of more than 90° C. for 48 hours is required, which can reduce shrinkage and creep of UHPC and increase concrete strength. However, how to ensure the temperature of on-site steam curing above 90° C. at a low cost has been a major problem for engineers.

SUMMARY OF THE PRESENT INVENTION

The present disclosure aims to provide a segmental joint of cast-in-place UHPC bridge beam and a construction method thereof, and the beam segment joint can greatly improve the strength of the bridge structure and facilitate on-site construction.

In order to achieve the above object, the technical solution adopted by the present disclosure is:

A segmental joint of cast-in-place UHPC bridge beam characterized by including a plurality of female joints disposed at an end of a first segment and a plurality of male joints disposed at an end of a second segment, wherein each female joints and the male joints are correspondingly connected to form a tongue-and-groove connection, and each of the male joints is of a structure with big outer part and small inner part.

In this way, through the design of the tongue-and-groove connection, the mutual bite force between the tongue-and-groove connections can be used to eliminate the weakening of the tensile strength of the joint caused by the artificial fracture of the UHPC plate or beam, thereby improving the structural strength of the bridge.

The beam segment joint of the present disclosure effectively reduces the amount of prestressed strands and the segment size, reduces the structural weight, and lowers the heat dissipation and energy loss in the curing, thereby greatly improving the application range of the segmental cast-in-place UHPC bridge and promoting development of the UHPC bridge.

The present disclosure is also applicable to joint connection and construction for UHPC bridge deck of UHPC-steel composite beam and UHPC composite box girder with corrugated steel webs.

In the construction or operation of the present disclosure, a tensile portion of the joint section, the top plate, the bottom plate and the web of the full section are all in the form of tongue-and-groove connection with "big outer part and small inner part" (ie, the top and bottom plates are made with "wide outer part and narrow inner part", and the web is made with "tall outer part and short inner part").

According to an embodiment of the present disclosure, the present disclosure can be further optimized, and the following is an optimized technical solution:

Preferably, according to two embodiments of the present disclosure, the tongue-and-groove connection is an inverted-trapezoid-shaped tongue or a T-shaped tongue.

According to embodiment one of the present disclosure, the inverted-trapezoid-shaped tongue-and-groove connection meets the following conditions: $b_2 \geq 10$ cm; $1.6b_2 \geq b_1 \geq 1.2b_2$; $0.8b_2 \geq h \geq 0.5b_2$; $80° \geq \beta \geq 60°$; wherein $b_2$ is a root width of the male joint, $b_1$ is a top width of the male joint, h is the protruded height of the male joint, and β is an angle between a side surface of the male joint and a top surface of the male joint.

According to embodiment two of the present disclosure, the T-shaped tongue-and-groove connection meets the following conditions:

$$b_4 \leq \frac{1}{3}b_3;\ h' \geq 1.5 \times b_4;\ 5\text{ cm} \leq b_4;$$

where $b_3$ is a root width of the male joint, $b_4$ is half of a difference between a top width of the male joint and a root width thereof, and h' is half of a protruded height of the male joint.

In order to further improve the force at the joint, a joint at the tongue-and-groove connection is provided with a connecting reinforcing bar spanning a seam. For the technical solution arranged with single-layer connection reinforcing bars, the end molds of the plates (because of the tongue-and-groove connection rather than a plane) need to be disconnected by the row of reinforcing bars, which are made into two parts and respectively removed to complete the demolding.

Since the tongue-and-groove connection joint is with big outer part and small inner part, the end formwork of the beam segment firstly poured (the end connected to the beam segment subsequently poured) can only be demolded by means of out-of-plane removal, that is, the direction in which the end mold of each plate is demolded is perpendicular to the plane of the plate.

The segmental joint of cast-in-place UHPC bridge beam is a full UHPC bridge deck joint of a UHPC-steel composite beam, a full UHPC bridge deck joint of a UHPC composite box girder with corrugated steel webs, or a joint between UHPC beam segments; the segmental cast-in-place UHPC bridge is a simply supported beam, a continuous beam or a continuous steel structure; a section form of the segmental cast-in-place UHPC bridge is a box-shaped beam, an I-beam, a T-beam, a π-beam or a plate beam.

Based on the same inventive concept, the present disclosure also provides a method of constructing the segmental joint of cast-in-place UHPC bridge beam, which includes the following steps:

S1, the segmental cast-in-place UHPC bridge is divided into a first segment that is poured firstly and a second segment that is poured subsequently during pouring, and the first segment that is poured firstly and the second segment that is poured subsequently are connected to form the bridge beam segment joints, where mutual bite force at the tongue-and-groove connection is made use of to eliminate weakening of a tensile strength at the joint caused by artificial fracture of the UHPC plate or beam; formworks used for the segmental cast-in-place UHPC bridge meets requirements for construction in place, where the formworks are made according to section forms of a top plate, a bottom plate and a web plate, and are divided into a top mold, a bottom mold, a side mold and an end mold; when the formworks are mounted, lengths of the top mold, the bottom mold and the side mold should exceed a position of the end mold, and when demolding, the top mold, the bottom mold and the side mold are removed first, and the end mold is finally removed in a manner of out-of-plane removal; and S2, the segmental cast-in-place UHPC bridge is steam-cured on site for 1 to 3 days after cast-in-place construction, steam curing being carried out in a heat insulation measures, then the newly poured beam segment are wrapped well by an inner layer film and an outer layer aerogel insulation composite and steam-cured for 2 to 3 days above 90° C.

Preferably, in the case of steam curing, the temperature rising rate of a cavity formed by the formworks is less than or equal to 10° C./h, the temperature is kept constant after reaching 90° C., and after the temperature is kept constant for 48 hours, it is cooled to a normal temperature at a rate of 10° C./h or less Preferably, when the tongue-and-groove connection is provided with connecting reinforcing bars, a section of the connecting reinforcing bar at the tongue-and-groove connection of the first segment that is poured firstly is reserved at the outside, and the reserved connecting reinforcing bar is buried in the second segment that is poured subsequently.

Preferably, at a connection with an existing beam segment, the inner layer film and the outer layer aerogel insulation composite extend to cover the existing beam for greater than or equal to 50 cm in length;

Preferably, the aerogel insulation composite has a thickness of 3 to 10 mm.

Compared with the prior art, the beneficial effects of the present disclosure are:

The present disclosure is significantly different from the shape of the joint of the prior invention. Firstly, regarding the object, the present disclosure is directed to the cast-in-place beam segment, while the prior art is directed to the UHPC layer in the lightweight composite bridge deck; secondly, regarding the improvement, the present disclosure is aimed for improvement of both shearing resistance and bending resistance.

The on-site steam curing proposed by the present disclosure by introducing a film which has a good flow blocking property and an aerogel insulation composite which has a very low thermal conductivity into the UHPC can solve the problem of ensuring that the temperature of the on-site steam cured component is above 90° C. at a low cost. Aerogel insulation composite is formed by nano-silica aerogel as the main material which is compounded with glass fiber cotton or pre-oxidized fiber felt by special process. It is characterized by low thermal conductivity and its own tensile strength and compressive strength. However, it does not have a good performance of preventing high-temperature water vapor from passing through, and thus it is required to be used with a film with good flow resistance to achieve excellent heat preservation.

The present disclosure not only applies to the joint connection between the segmental cast-in-place UHPC beam segments and the construction of the segmental cast-in-place UHPC beam segment, but also to joint connection of UHPC bridge deck of UHPC-steel composite beam and of full UHPC bridge deck of UHPC composite box girder with corrugated steel webs and to UHPC bridge deck construction.

BRIEF DESCRIPTION OF THE DRAWINGS

In order to more clearly illustrate the embodiments of the present specification or the technical solutions of the prior art, the drawings used in the embodiments or the description in the prior art will be briefly described below. Obviously, the drawings in the following description are some embodiments of the present disclosure, and other drawings can be obtained by those skilled in the art without any creative work.

In the drawings.

Figure 1:
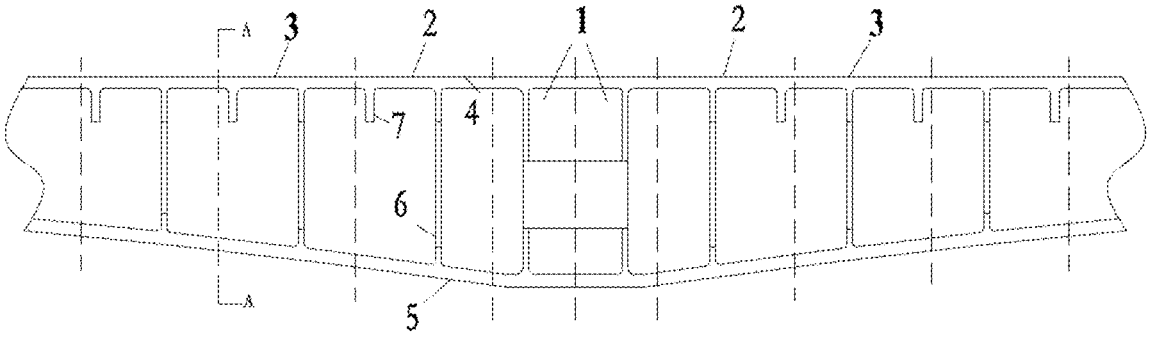
FIG. 1 is a schematic view showing the pouring of a continuous cast-in-place UHPC box girder according to an embodiment of the present disclosure.

1, cast-in-place segment 1# block; 2, cast-in-place segment 2# block; 3, cast-in-place segment 3# block; 4, top plate; 5, bottom plate; 6. transverse baffle; 7, transverse rib; 8, web plate 9, the first segment; 10, the second segment; 11 joint; 12, tongue-and-groove connection; 121, female joint; 122, male joint; 13, inverted-trapezoid-shaped tongue-and-groove connection; 14, connecting steel; 15, T-shaped tongue-and-groove connection; 16, top mold; 17, bottom mold; 18, side mold; 19, end mold; 20, reinforcing bar reserved hole; 21, film; 22, aerogel insulation composite; 26, formwork.

DETAILED DESCRIPTION OF THE PRESENT DISCLOSURE

For a better understanding of the present disclosure, the present disclosure will be described more fully and in detail with reference to the accompanying drawings and preferred embodiments, but the scope of the present disclosure is not limited to the following embodiments. It should be noted that the embodiments of the present disclosure and the features of the embodiments may be combined with each other without conflict. For convenience of description, the words "upper", "lower", "left", and "right" appearing below are only consistent with the upper, lower, left, and right directions of the drawing itself, and do not limit the structure.

Unless otherwise defined, the technical terms used hereinafter have the same meaning as understood by those skilled in the art. The technical terms described herein are for the purpose of describing the specific embodiments only and are not intended to limit the scope of the present disclosure. Various raw materials, equipment, and the like used in the present disclosure are commercially available or can be produced by an existing method.

A segmental joint form of UHPC bridge beam and a UHPC construction method thereof are disclosed. The UHPC bridge beam segment joint form of the present disclosure refers to a joint form between cast-in-place segmental UHPC beam segments. The construction method adopted for the bridge structure of the present disclosure is the segmental cast-in-place construction method, including the hanging basket construction method, the segmented bracket construction method, the moving formwork construction method, and the like, which are applicable to on-site segmental pouring.

The segmental joint of cast-in-place UHPC bridge beam of the present disclosure includes a full UHPC bridge deck joint of a UHPC-steel composite beam, a full UHPC bridge deck joint of a UHPC composite box girder with corrugated steel webs, or a joint between UHPC beam segments; the segmental cast-in-place UHPC bridge is a simply supported beam, a continuous beam or a continuous steel structure; a section form of the segmental cast-in-place UHPC bridge is a box-shaped beam, an I-beam, a T-beam, a π-beam or a plate beam. For convenience of description, the present disclosure will be described by taking only a continuous box girder bridge as an example.

The segmental cast-in-place UHPC bridge according to the present disclosure includes a firstly poured first segment 9 and a subsequently poured second segment 10 during pouring. The firstly poured first segment 9 and the subsequently poured second segment 10 are connected to form the bridge beam segment joint 11, and the joint 11 includes a plurality of female joints 121 disposed at the ends of the first segments 9, and a plurality of male joints 122 disposed at the ends of the second segments 10. Each female joint 121 and male joint 122 are connected correspondingly to each other to form the tongue-and-groove connection 12, and each of the male joints 122 has a structure with big outer part and small inner part. It should be noted that a plurality of male joints 122 may be disposed at the end of the first segment 9 and a plurality of female joints 121 at the end of the second segment 10.

Figure 3:
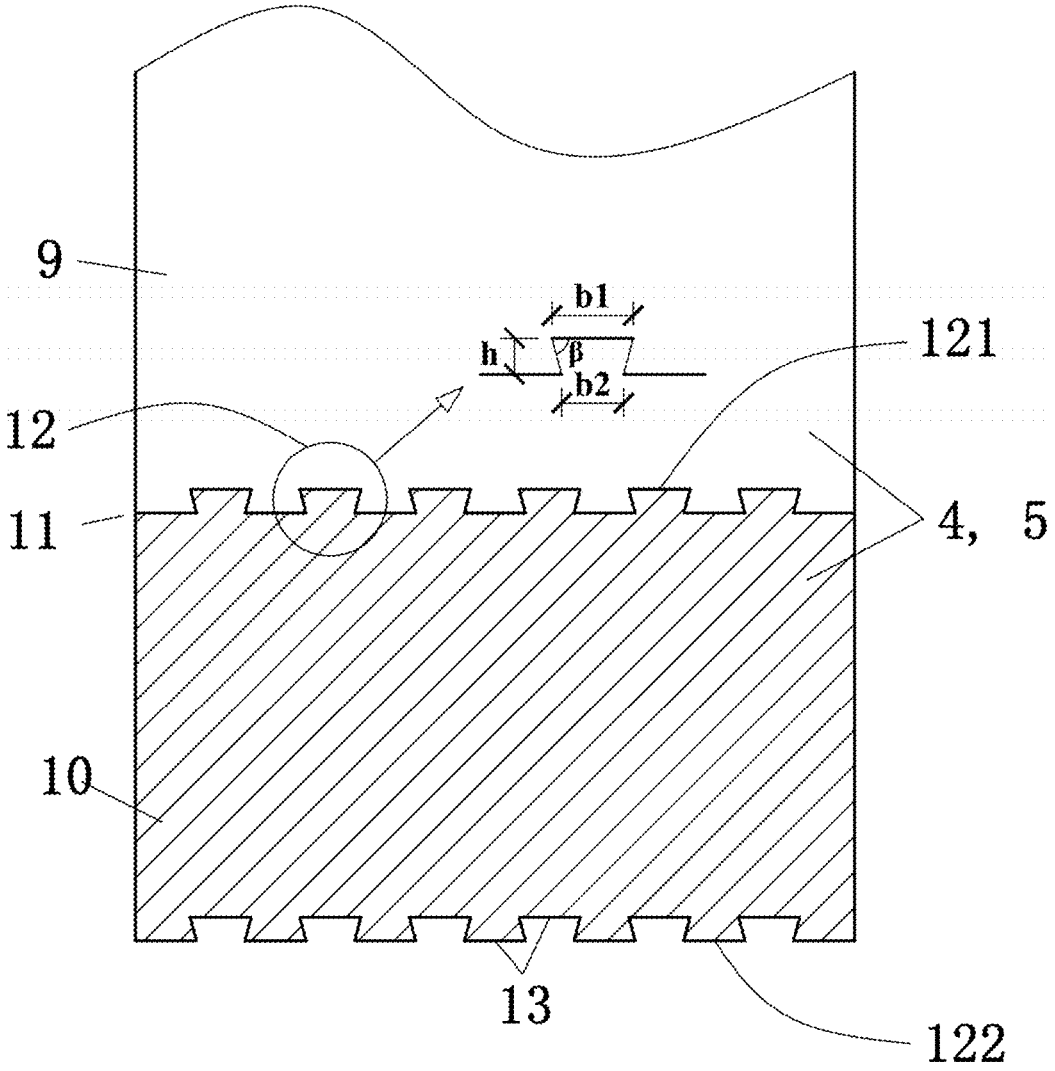
FIG. 3 is a schematic cross-sectional view showing the inverted-trapezoid-shaped tongue-and-groove connection of the top (bottom) plate portion (B-B section) of the continuous box girder in embodiment one.
Figure 4:
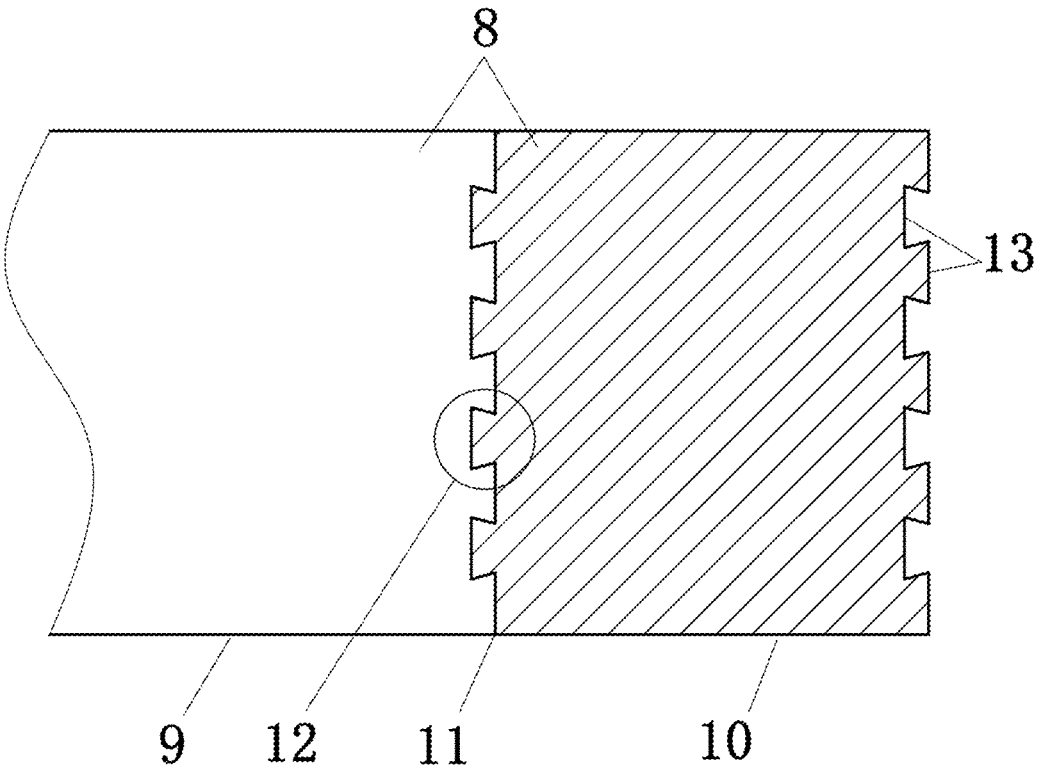
FIG. 4 is a schematic cross-sectional view showing the inverted-trapezoid-shaped tongue-and-groove connection of the web portion (C-C section) of the continuous box girder in embodiment one.
Figure 5:
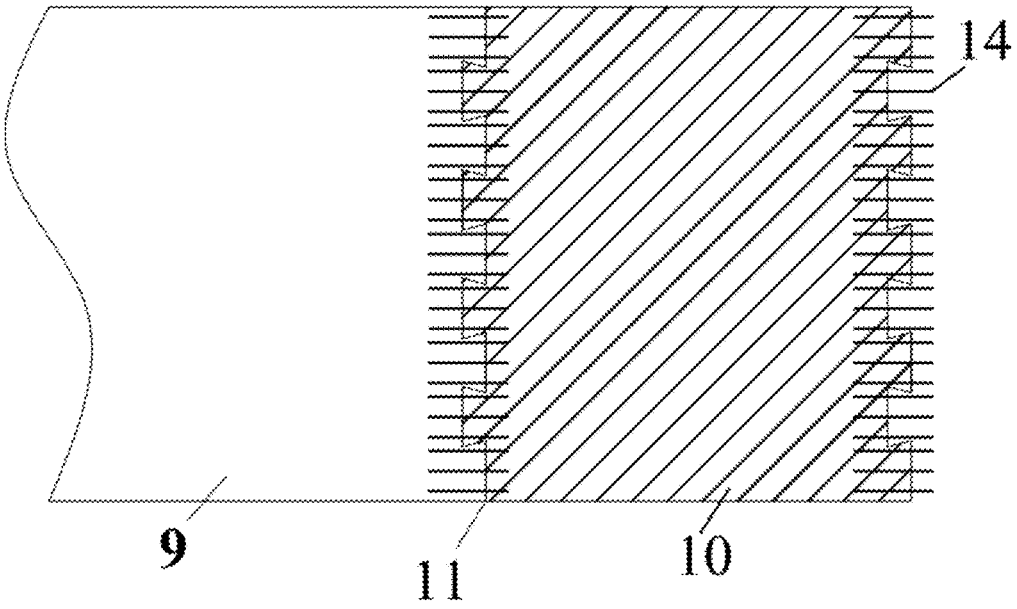
FIG. 5 is a schematic view showing the reinforcement of the inverted-trapezoid-shaped tongue-and-groove connection of the continuous box girder in embodiment one.
Figure 6:
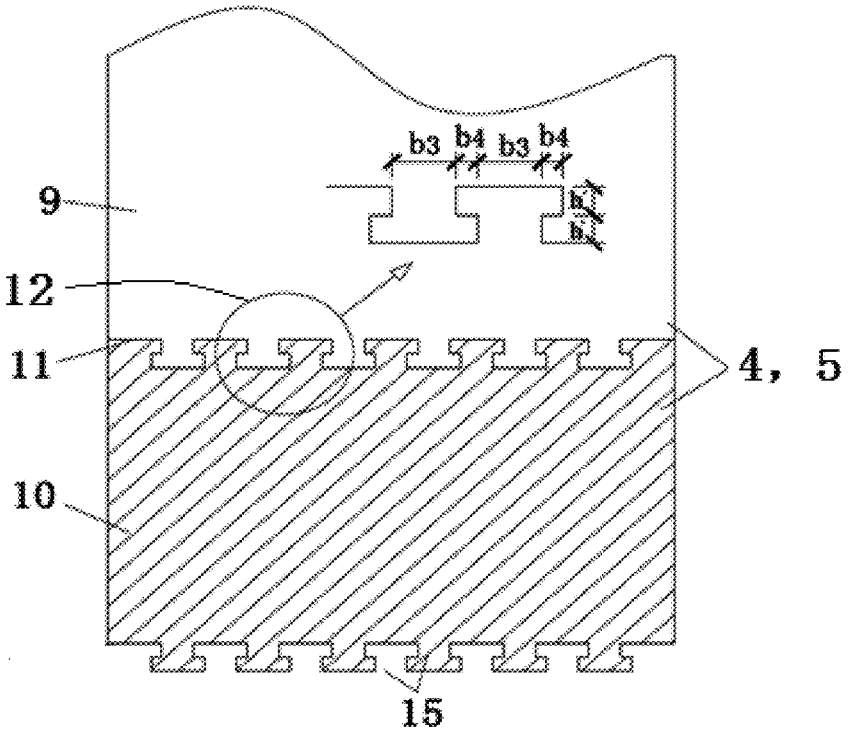
FIG. 6 is a schematic cross-sectional view showing the T-shaped tongue-and-groove connection of the top (bottom) plate portion (B-B section) of the continuous box girder in embodiment two.
Figure 7:
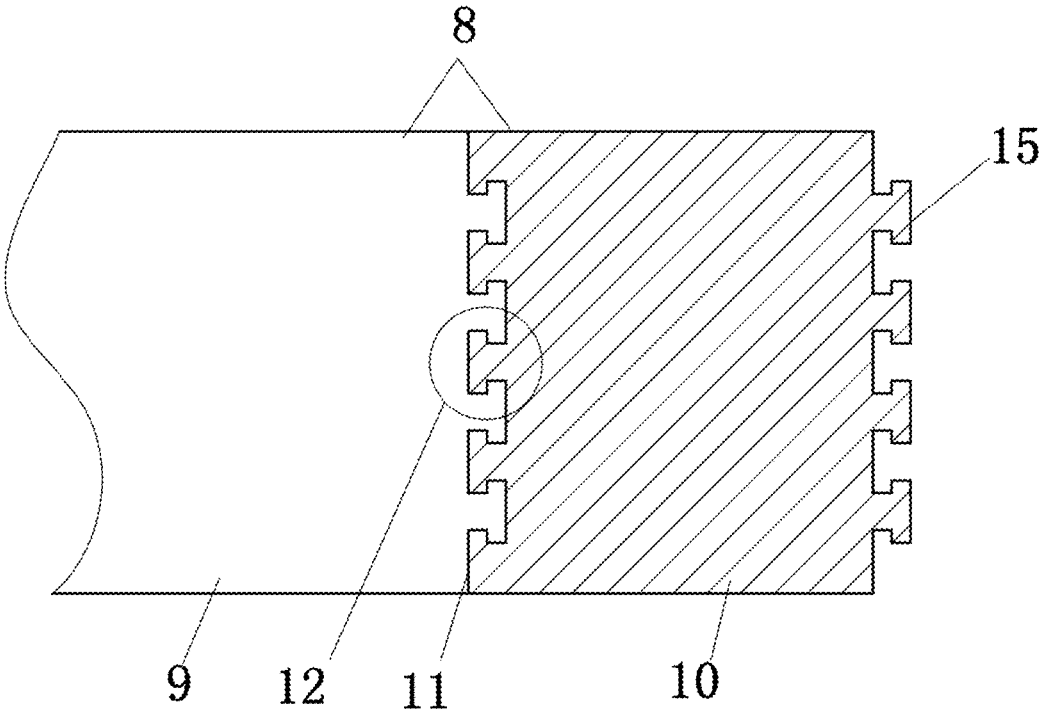
FIG. 7 is a schematic cross-sectional view showing the T-shaped tongue-and-groove connection of the web portion (C-C section) of the continuous box girder in embodiment two.
Figure 8:
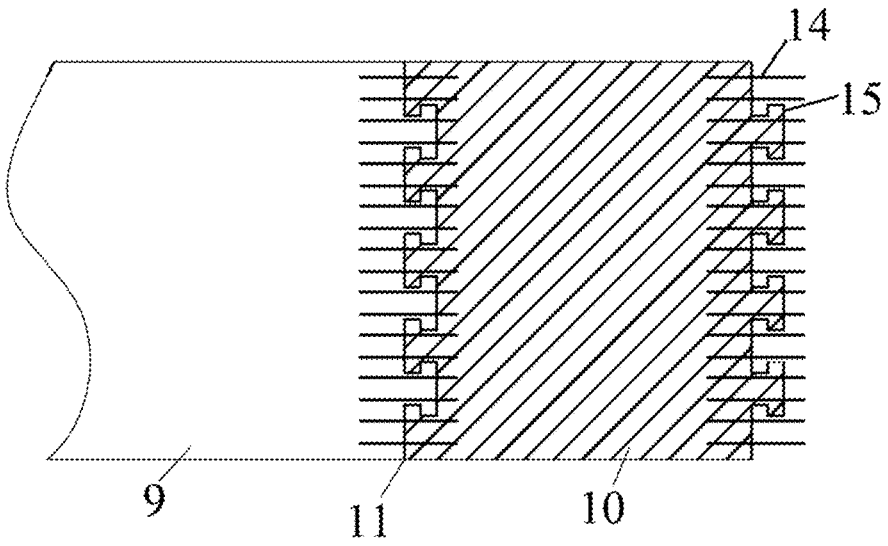
FIG. 8 is a schematic view showing the reinforcement of the T-shaped tongue-and-groove connection joint of the continuous box girder in embodiment two.

In the present disclosure, good connection is formed between the firstly poured UHPC and the subsequently poured UHPC by adopting a tongue-and-groove connection 12 with wide outer part and narrow inner part, and the mutual bite force between the tongue-and-groove connections 12 is fully utilized to eliminate weakening of tensile strength at the joint of the UHPC plate (beam) due to artificial fracture. The tongue-and-groove connection 12 may be an inverted-trapezoid-shaped tongue-and-groove connection 13 or a T-shaped tongue-and-groove connection 15, etc., wherein the design parameters of the inverted-trapezoid-shaped tongue 13 meets the following conditions: $b_2 \geq 10$ c m; $1.6b_2 \geq b_1 \geq 1.2b_2$; $0.8b_2 \geq h \geq 0.5b_2$; $80° \geq \beta \geq 60°$; wherein $b_2$ is a root width of the male joint, $b_1$ is a top width of the male joint, h is the protruded height of the male joint, and β is an angle between a side surface of the male joint and a top surface of the male joint, the reference numerals is shown in FIG. 3; the T-shaped tongue-and-groove connection meets the following conditions:

$$b_4 \le \frac{1}{3}b_3;\ h' \ge 1.5 \times b_4;\ 5\ \text{cm} \le b_4;$$

where $b_3$ is a root width of the male joint, $b_4$ is half of a difference between a top width of the male joint and a root width thereof, and h' is half of a protruded height of the male joint the reference numerals is shown in FIG. 6.

The new and old joints 11 of the segmental cast-in-place UHPC bridge of the present disclosure may be provided with connecting reinforcing bars 14 or not with connecting reinforcing bars 14 using the biting force of the tongue-and-groove connection. When the tongue-and-groove connection 12 is provided with connecting reinforcing bars 14 (considering only a single-layer reinforcing bar is provided), a length of connecting reinforcing bars 14 is reserved out of the tongue-and-groove connection of the firstly poured first segment 9, so that the reserved connecting reinforcing bar 14 is buried in the subsequently poured second segment 10. According to actual need, the connecting reinforcing bars 14 of the tongue-and-groove connection 12 located at the joint 11 can be appropriately densified, especially in the tension region of the joint 11. The densified connecting reinforcing bars 14 are advantageous for increasing the connection strength between the firstly poured first segment 9 and the subsequently poured second segment 10.

The formwork used for the segmental cast-in-place UHPC bridge according to the present disclosure needs to meet the requirements of on-site construction. According to the cross section of the top plate 4, the bottom plate 5 and the web plate 8, the formwork 26 is divided into top mold 16, bottom mold 17, side mold 18, end mold 19, and the like. When the joint 11 is provided with single-layer connecting reinforcing bars 14, the end mold 19 is divided into two parts in the thickness direction of the casting plate member, and a certain number of reinforcing bar reserved holes 20 are reserved in the middle of the two end molds, with a shape of semi-circular; when the joint is not provided with connecting reinforcing bars 14, the end mold 19 should be integral in the thickness direction of the cast plate. When the mold is mounted, the length of the top mold 16, the bottom mold 17, and the side mold 18 should appropriately exceed the position of the end mold 19. When demolding, the 16 top mold, the bottom mold 17, the side mold 18 should be removed first, and finally the end mold is removed in a manner of out-of-plane removal (i.e., it is removed perpendicularly to the plane in which the plate is cast).

The segmental cast-in-place UHPC bridge according to the present disclosure adopts on-site pouring construction and on-site steam curing, and the steam curing is carried out in a heat insulation measures, that is, in a closed space formed by the inner layer film 21 with good flow resistance and outer aerogel insulation composite 22 with extremely low thermal conductivity together with an existing beam segment (a beam segment that has been steam cured and has sufficient strength). The specific method for forming the closed space is: the outer surface of the newly poured box girder (including the formwork) to be steam cured is wrapped with the inner layer film 21 with good flow resistance and outer aerogel insulation composite 22 with extremely low thermal conductivity; specifically, at the joint with the existing beam segment, the inner layer film 21 and the outer layer aerogel insulation composite 22 are extended to cover the existing beam body for a length of greater than or equal to 50 cm, and for the inner part of the box girder, a manhole needs to be opened for convection with the inner layer film 21 and the outer aerogel insulation composite 22; at the front end of the cast-in-place segment (i.e., the other end), the inner film 21 and the outer aerogel insulation composite 22 should be extended to cover the whole outside of the box girder (including the side surface, the top surface, the bottom surface and the end surface). The above aerogel insulation composite has a thickness of 3 to 10 mm. It can be steam cured in a state of being engaged with the steel formwork (covering the outer surface of the formwork) without completely removing the formwork, or it can be steam cured in a state of directly covering the outer surface of the firstly poured beam segment after the formwork is completely removed.

The general flow of the steam curing of the segmental cast-in-place UHPC bridge of the present disclosure is as follows: after the pouring is completed, the normal curing is carried out in the formwork for 1-3 days, and then the inner layer film 21 and the outer layer aerogel insulation composite 22 are used to make the new poured beam segment well wrapped. High-power steam generator is used to continuously manufacture steam to perform steam curing above 90° C. for 2 to 3 days. Preferably, the steam generator is movable.

Embodiment 1

Figure 2:
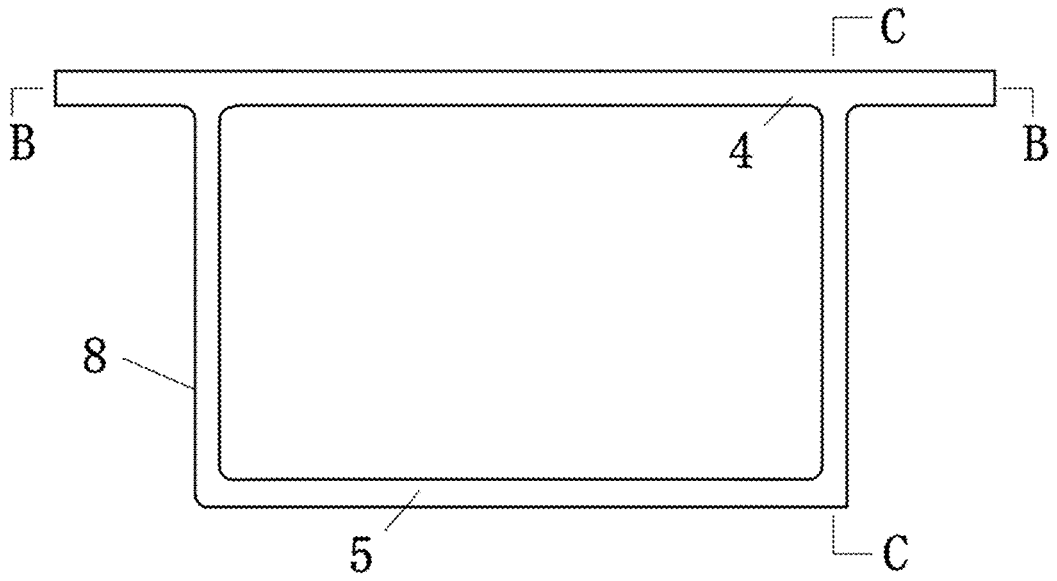
FIG. 2 is a schematic cross-sectional view along A-A of the UHPC box girder of FIG. 1.

As shown in FIG. 1 to FIG. 5 and FIG. 9, a segmented cast-in-place UHPC bridge structure and a construction method thereof are disclosed. The UHPC bridge structure referred to in the present disclosure refers to a high-strength lightweight bridge structure made from ultra-high performance concrete material doped with steel fiber. The bridge structure described in this embodiment adopts on-site cantilever symmetric segment casting, a cast-in-place segment 1# block is firstly poured, and then a cast-in-place segment 2# block, a cast-in-place segment 3# block, etc. in sequence are poured by the bracket or hanging basket construction method, as shown in FIG. 1. Referring to FIG. 2, the cross section of the bridge structure described in this embodiment adopts a box-shaped segment.

The adjacent segments of the box girder according to the embodiment may be divided into a first segment 9 that is poured firstly and a second segment 10 that is poured subsequently during pouring, and the first segment 9 that is poured firstly and the second segment 10 that is poured subsequently are connected to form the bridge beam segment joints 11, and the joint 11 includes a tongue-and-groove connection 12 designed to be with wide outer part and narrow inner part, including an inverted-trapezoid-shaped tongue-and-groove connection 13, and the an inverted-trapezoid-shaped tongue-and-groove connection 13 used in this embodiment. meet the following conditions: $b_2 \ge 10$ cm; $1.6b_2 \ge b_1 \ge 1.2b_2$; $0.8b_2 \ge h \ge 0.5b_2$; $80° \ge \beta \ge 60°$. In order to facilitate the connection with the reinforcing bars of the subsequently poured beam segments and the strength increase of the tension zone of the tongue-and-groove connection 12, in the present embodiment, the tongue-and-groove connection joints are designed to be provided with connecting reinforcing bars. Taking into account the cross-sectional shape of the tongue-and-groove connection 12 and the method of demolding, the connecting reinforcing bars 14 and the joint 11 are only arranged as a single layer of reinforcing bars.

Figure 9:
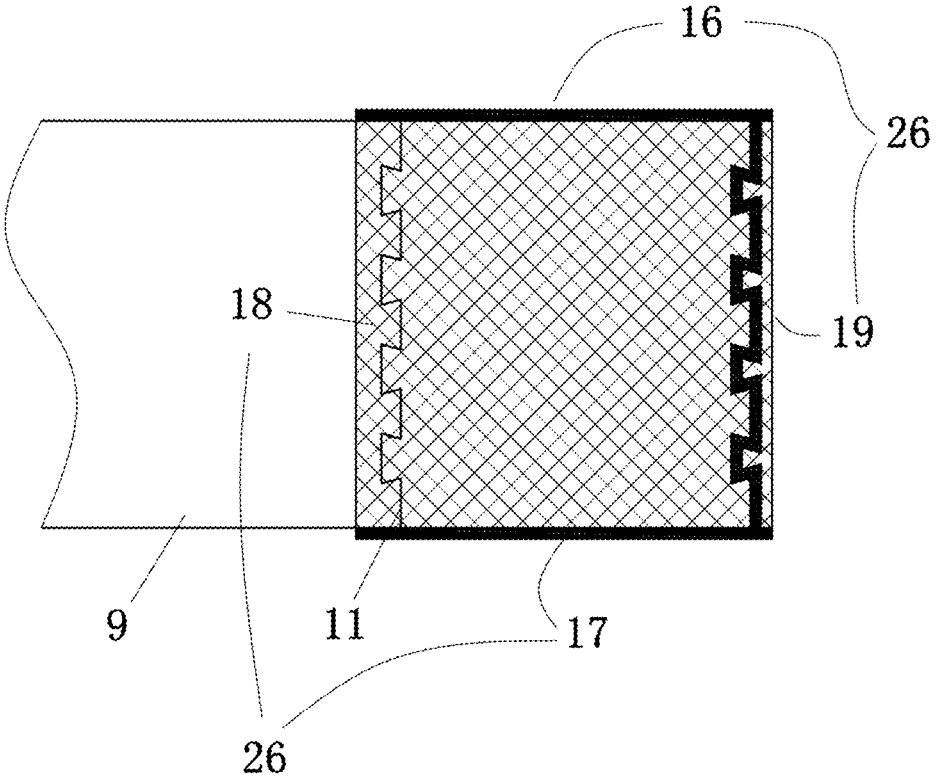
FIG. 9 is a schematic view showing the formwork arrangement of a C-C section of the continuous box girder according to an embodiment.
Figure 10:
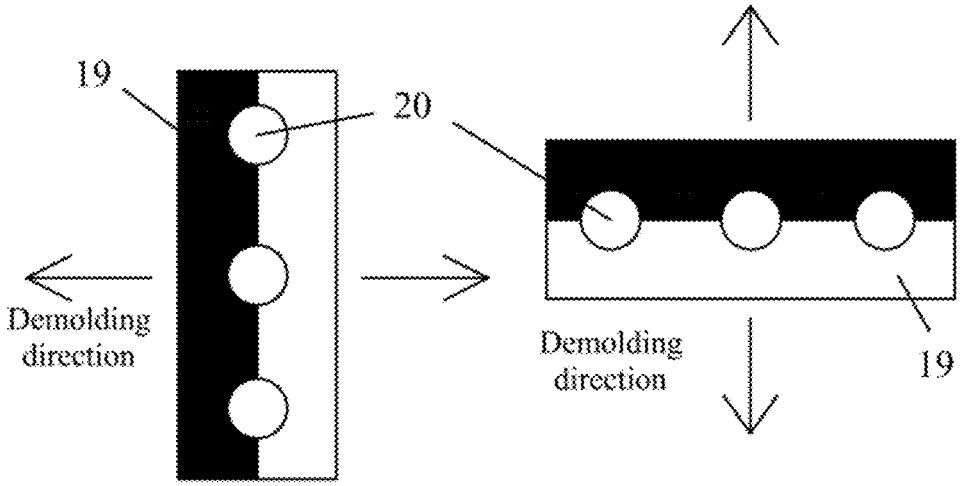
FIG. 10 is a schematic view showing the design and demolding mode of the end mold of the continuous box girder end mold according to an embodiment.

The formwork 26 used in the segmental cast-in-place UHPC bridge described in this embodiment is a specially manufactured formwork 26, and the strength and rigidity of the formwork 26 should meet the requirements for construction. The formwork 26 is divided into top mold 16, bottom mold 17, side mold 18, end mold 19, and the like. When the mold is mounted, the splicing length of the top mold 16, the side mold 18, and the bottom mold 17 should appropriately exceed the position of the end mold 19, as shown in FIG. 9. In this embodiment, the end mold 19 should be equally divided into two parts according to the thickness of the plate member, and a certain number of reinforcing bar reserved holes 20 are reserved in the middle of the two end molds, with a shape of semi-circular, as shown in FIG. 10. Before pouring, the bolt hole portion outside the front end mold 19 is sealed to prevent leakage. When demolding, the top mold 16, the side mold 18, and the bottom mold 17 should be removed first, and finally the end mold 19 is removed in a manner of out-of-plane removal, as shown in FIG. 10.

Figure 11:
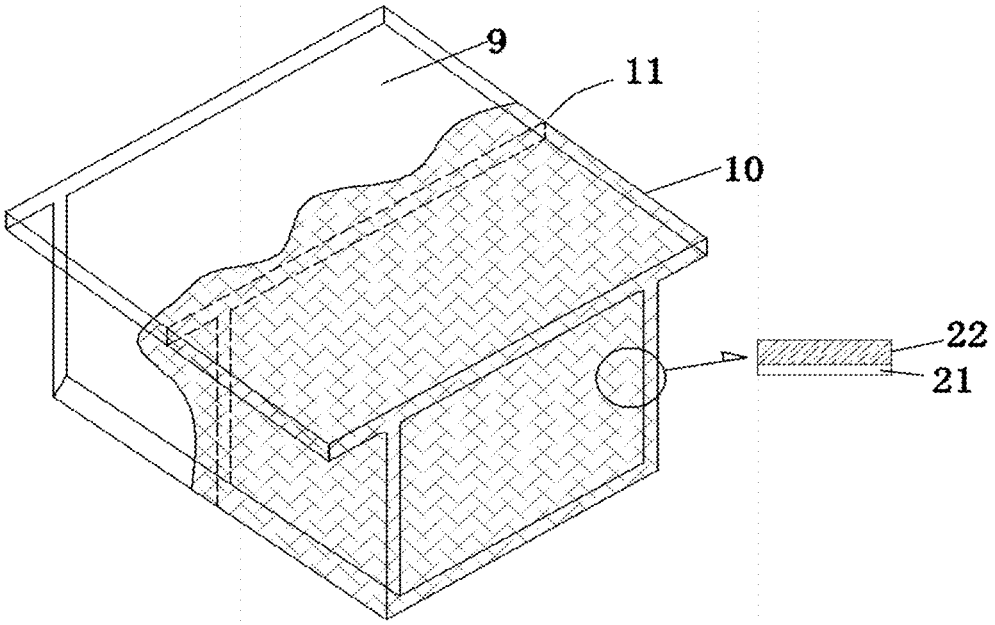
FIG. 11 is a schematic diagram of the steam curing of a new poured beam segment using aerogel insulation composite.

The curing method adopted for the segmental cast-in-place UHPC bridge described in this embodiment is steam curing, and a new type of thermal insulation material, aerogel insulation composite 22, is adopted for heat insulation in the curing, as shown in FIG. 11. The general flow of the steam curing of the segmental cast-in-place UHPC bridge in this embodiment is as follows: demolding is performed after normal curing for 2 to 3 days in the formwork after pouring, and the film 21 together with the aerogel insulation composite 22 is used to well wrap the newly poured beam segment; the high-power steam generator is used to continuously produce steam. Preferably, the steam generator is placed on the firstly poured first segment 9, and steam cured for 48 hours at a temperature above 90° C. During the curing process, the temperature change in the curing shed is concerned. It is recommended to read the temperature of the measuring point every 4 hours, and there should be no local temperature difference. The internal heating rate is 10° C./h or less, the temperature is kept constant after reaching 90° C., and after the temperature is kept constant for 48 hours, it is cooled to a normal temperature at a rate of 10° C./h or less.

Embodiment 2

As shown in FIG. 1 to FIG. 2 and FIG. 6 to FIG. 9, a segmental cast-in-place UHPC bridge structure and a construction method thereof are disclosed, which are the same as in embodiment one. The joint 11 between adjacent poured segments also includes a tongue-and-groove connection 12 with wide outer part and narrow inner part. The difference compared with embodiment one is that, the joint 11 of the present embodiment employs a T-shaped tongue-and-groove connection 15 (see FIGS. 6 and 7). Connecting reinforcing bars 14 needs to be reserved outside of the firstly poured first segment to facilitate engagement with the connecting reinforcing bars 14 of the subsequently poured second segment, wherein the engagement of the connecting reinforcing bars 14 is preferably made by welding. The connecting reinforcing bars 14 provided at the T-shaped tongue-and-groove connection 15 is designed as in FIG. 8. The T-shaped tongue-and-groove connection 15 used in this embodiment needs to meets the following conditions:

$$b_4 \le \frac{1}{3}b_3;\ h' \ge 1.5 \times b_4;\ 5\ \text{cm} \le b_4.$$

The parameters of the tongue-and-groove connection 12 of the present embodiment generally falls within the above range, but is not limited thereto. Other design and construction requirements are the same as those in embodiment one, and will not be further described herein.

The above description illustrates the segmental cast-in-place UHPC bridge structure and its construction method in an exemplary and illustrative manner. It is not intended to limit the present disclosure to the specific structure and scope of application. Therefore, all possible modifications and equivalents which may be utilized are all within the scope of the patent application.

The above-described embodiments are to be understood as being illustrative only and are not intended to limit the scope of the present disclosure. Upon reading the present disclosure, various equivalent modifications made to the present disclosure by one skilled in the art are intended to fall within the scope of the appended claims.

What is claimed is:

1. A segmental joint of cast-in-place UHPC bridge beam, comprising a plurality of female joints disposed at an end of a first segment and a plurality of male joints disposed at an end of a second segment, wherein each female joints and the male joints are correspondingly connected to form a tongue-and-groove connection, and each of the male joints is of a structure with big outer part and small inner part; wherein the tongue-and-groove connection is an inverted-trapezoid-shaped tongue-and-groove connection or a T-shaped tongue-and-groove connection, and wherein the inverted-trapezoid-shaped tongue-and-groove connection meets the following conditions:

$b_2 \ge 10$ cm; $1.6b_2 \ge b_1 \ge 1.2b_2$; $0.8b_2 \ge h \ge 0.5b_2$; $80° \ge \beta \ge 60°$;

wherein $b_2$ is a root width of the male joint, $b_1$ is a top width of the male joint, h is the protruded height of the male joint, and β is an angle between a side surface of the male joint and a top surface of the male joint.

2. The segmental joint of cast-in-place UHPC bridge beam according to claim 1, wherein the T-shaped tongue-and-groove connection meets the following conditions:

$$b_4 \le \frac{1}{3}b_3;\ h' \ge 1.5 \times b_4;\ 5\ \text{cm} \le b_4;$$

where $b_3$ is a root width of the male joint, $b_4$ is half of a difference between a top width of the male joint and a root width thereof, and h' is half of a protruded height of the male joint.

3. The segmental joint of cast-in-place UHPC bridge beam according to claim 1, wherein a joint at the tongue-and-groove connection is provided with a connecting reinforcing bar spanning a seam.

4. The segmental joint of cast-in-place UHPC bridge beam according to claim 1, wherein the segmental cast-in-place UHPC bridge beam segment joint is a full UHPC bridge deck joint of a UHPC-steel composite beam, a full UHPC bridge deck joint of a UHPC composite box girder with corrugated steel webs, or a joint between UHPC beam segments; the segmental cast-in-place UHPC bridge is a simply supported beam, a continuous beam or a continuous steel structure; a section form of the segmental cast-in-place UHPC bridge is a box-shaped beam, an I-beam, a T-beam, a π-beam or a plate beam.

5. A method of constructing the segmental joint of cast-in-place UHPC bridge beam according to claim 1, comprising steps of:

S1, the segmental cast-in-place UHPC bridge is divided into a first segment that is poured firstly and a second segment that is poured subsequently during pouring, and the first segment that is poured firstly and the second segment that is poured subsequently are connected to form the bridge beam segment joints, where mutual bite force at the tongue-and-groove connection is made use of to eliminate weakening of a tensile strength at the joint caused by artificial fracture of the UHPC plate or beam; formworks used for the segmental cast-in-place UHPC bridge meets requirements for construction in place, where the formworks are made according to section forms of a top plate, a bottom plate and a web plate, and are divided into a top mold, a bottom mold, a side mold and an end mold; when the formworks are mounted, lengths of the top mold, the bottom mold and the side mold should exceed a position of the end mold, and when demolding, the top mold, the bottom mold and the side mold are removed first, and the end mold is finally removed in a manner of out-of-plane removal; and S2, the segmental cast-in-place UHPC bridge is steam-cured on site for 1 to 3 days after cast-in-place construction, steam curing being carried out in a heat insulation measures, then the newly poured beam segment are wrapped well by an inner layer film and an outer layer aerogel insulation composite and steam-cured for 2 to 3 days above 90° C.

6. The method of constructing the segmental joint of cast-in-place UHPC bridge beam according to claim 5, wherein in the case of steam curing, the temperature rising rate of a cavity formed by the formworks is less than or equal to 10° C./h, the temperature is kept constant after reaching 90° C., and after the temperature is kept constant for 48 hours, it is cooled to a normal temperature at a rate of 10° C./h or less.

7. The method of constructing the segmental joint of cast-in-place UHPC bridge beam according to claim 5, wherein when the tongue-and-groove connection is provided with connecting reinforcing bars, a section of the connecting reinforcing bar at the tongue-and-groove connection of the first segment that is poured firstly is reserved at the outside, and the reserved connecting reinforcing bar is buried in the second segment that is poured subsequently.

8. The method of constructing the segmental joint of cast-in-place UHPC bridge beam according to claim 5, wherein at a connection with an existing beam segment, the inner layer film and the outer layer aerogel insulation composite extend to cover the existing beam for greater than or equal to 50 cm in length.

* * * * *